US006391953B1

(12) United States Patent
Hütte et al.

(10) Patent No.: US 6,391,953 B1
(45) Date of Patent: May 21, 2002

(54) COATING COMPOUND FOR FIBRES

(75) Inventors: Stephan Hütte, Köln; Bernd Klinksiek, Bergisch Gladbach; Andreas Endesfelder, Overath; Hans-Joachim Wollweber, Krefeld; Hans-Josef Behrens, Dormagen, all of (DE)

(73) Assignees: Bayer Aktiengesellschaft, Leverkusen; Bayer Faser GmbH, Dormagen, both of (DE)

( * ) Notice: Subject to any disclaimer, the term of this patent is extended or adjusted under 35 U.S.C. 154(b) by 0 days.

(21) Appl. No.: 09/245,453

(22) Filed: Feb. 5, 1999

(30) Foreign Application Priority Data

Feb. 9, 1998 (DE) ..... 198 05 104

(51) Int. Cl.[7] ..... C08J 5/10; C08K 5/41; C08L 83/04

(52) U.S. Cl. ..... 524/173; 524/127; 524/270; 524/322

(58) Field of Search ..... 524/261, 173, 524/434, 435, 436, 270, 127, 322, 267, 474, 476

(56) References Cited

U.S. PATENT DOCUMENTS

| | | | | |
|---|---|---|---|---|
| 3,039,895 A | | 6/1962 | Yuk | 117/138.8 |
| 3,717,575 A | | 2/1973 | Rankin | 252/8.8 |
| 3,953,339 A | | 4/1976 | Obetz et al. | 252/8.9 |
| 4,064,057 A | | 12/1977 | Koerner et al. | 252/8.6 |
| 4,144,176 A | | 3/1979 | Kawanaka et al. | 252/8.7 |
| 4,296,174 A | | 10/1981 | Hanzel et al. | 428/389 |
| 4,830,759 A | * | 5/1989 | Charlier | 210/749 |
| 5,135,575 A | | 8/1992 | Yang et al. | 106/287 |
| 5,147,412 A | | 9/1992 | Klinksiek et al. | 23/293 |
| 5,151,218 A | * | 9/1992 | Haubennestel et al. | 252/351 |
| 5,302,660 A | | 4/1994 | Klinksiek et al. | 524/871 |
| 5,595,675 A | | 1/1997 | Aso et al. | 252/8.61 |
| 5,639,715 A | * | 6/1997 | Patel | 507/135 |

FOREIGN PATENT DOCUMENTS

| | | | |
|---|---|---|---|
| DE | 28 28 177 | 1/1979 | |
| DE | 251578 | 11/1987 | C21D/1/10 |
| DE | 196 15 983 C1 | 7/1997 | |
| EP | 0 399 266 A2 | 11/1990 | |
| EP | 0 704571 A2 | 4/1996 | |
| GB | 1548224 | 7/1979 | |

OTHER PUBLICATIONS

C.R. Caryl et al. "Esters of Sodium Sulfosuccinic Acid" Industrial and Engineering Chemistry, published by the American Chemical Society vol. 31 (Jan. 1939) pp. 44–47 plus title page.
"Kunstsoffadditive" by R. Gächter and H. Müller, Carl–Hanser–Verlag, Munich, vol. 3, (1990) pp. 779–805.
H. Gall et al. "Polyurethan–Elstomerfasern" Kunstoff–Handbuch 7, (1993) pp. 679–694.
Abstract of JP60081374 (May 9, 1985 ).
Abstract of JP 60067442 (Sep. 22, 1983).
Derwent Abstract of JP 10310979 (Nov. 24, 1998).
Patent Abstracts of Japan, JP 09049167 (Feb. 18, 1997).
Derwent Abstract JP 61097471 (May 15, 1986).
Abstract of JP 092 17 283, dated Aug. 19, 1997.

* cited by examiner

*Primary Examiner*—James J. Seidleck
*Assistant Examiner*—U. K. Rajguru
(74) *Attorney, Agent, or Firm*—Norris McLaughlin & Marcus

(57) ABSTRACT

The invention relates to a coating compound for fibers and to a process for the production thereof The invention relates in particular to a preparation agent for elastanes, based on a dispersion of fatty-acid metal salts and an agglomeration inhibitor in polyorganosiloxanes and mineral oils. The preparations are produced by a precipitation process from which fined-particle and sedimentation-stable dispersions with a narrow particle size distribution are obtained which are free from agglomerates.

17 Claims, 2 Drawing Sheets

COATING COMPOUND FOR FIBRES

The invention relates to a coating compound for fibers and to a process for the preparation thereof. The invention relates in particular to a preparation agent for elastanes based on a dispersion of fatty-acid metal salts and agglomeration inhibitor in polyorganosiloxanes and mineral oils. The preparations are produced by a precipitation process from which fine-particle and sedimentation-stable dispersions with a narrow particle size distribution are obtained and which are free from agglomerates. The coating compound reduces the electrical resistance of elastanes, no deposits of the coating compound on machine parts occurring during either the application or processing of the elastanes, even over a long period. Elastanes treated with the coating compound do not stick even after a long storage period, and remain processable.

The expression fiber used within the context of the present invention includes staple fibers and/or continuous filaments. The fibers e.g. elastanes may be prepared by spinning processes well known in principle such as the dry spinning process, the wet spinning process or the melt spinning process.

Such spinning processes are described, for example, in Polyurethan-Elastomerfaser, H. Gail and M. Kausch in Kunststoff-Handbuch 7, Polyurethane, Editor: G. Oertel, Carl Hanser Verlag Munich Vienna, 1993, page 679 to 694.

Elastanes, i.e. elastic polyurethane fibers of long-chain synthetic polymers, which are composed of at least 85% segmented polyurethanes based on e.g. polyethers, polyesters and/or polycarbonates, are well known. Yarns made of such fibers are used for the production of flat goods or fabrics or materials which, in turn, are suitable inter alia for the preparation of foundation garments, linen, stockings, sportswear and tapes. Polyurethane fibers have a substantial stickiness compared with other non-elastic textile fibers. Sticking of elastanes occurs particularly if elastanes are wound onto a bobbin or a sectional beam. Sticking of elastanes and the increased adhesion of the fibers to one another is observed particularly if the fibers were stored for a long period prior for further processing. This effect is intensified if the material is stored at elevated temperature.

If the polyurethane fibers are processed with, for example, polyamide fibers or cotton by means of a warp knitting or circular knitting process or by stocking machines, the stickiness or the adhesion of elastanes on bobbins or sectional beams may lead to considerable tensions in the fiber during unwinding which may lead to thread breakage and, in an extreme case, may mean that bobbins or sectional beams of such fibers can no longer be processed.

In practice, a reduction in the stickiness or adhesion of elastanes after storage, even at elevated temperature is sought by a fiber treatment directly after production of the fiber by applying special preparation oils to the fiber.

In U.S. Pat. No. 3,039,895, the use of mineral oils and metal soaps dispersed therein, preferably magnesium stearate, is recommended for reducing the adhesion or stickiness of elastanes. In patent application EP 704 571 and U.S. Pat. No. 4,296,174, the use of low-viscosity, linear and branched polysiloxanes with metal soaps dispersed therein is recommended for reducing the stickiness of elastanes, magnesium stearate likewise being preferred. A disadvantage of the preparations described, however, is that the metal soaps dispersed in the oil may lead to deposits in the preparation system or to blockages when polyurethane fibers are coated by, for example, roll, yam guide or spray methods. A consequence of this is, for example, the shortened operating time of the spinning machines and an increased expenditure for cleaning the spinning machines and the preparation system. A reliable, uniform preparation of the polyurethane fibers over a long period is thus not possible using the preparation agents mentioned.

The preparation of dispersions stabilised against sedimentation, composed of magnesium stearate in polyorganosiloxanes or mineral oils is described in U.S. Pat. No. 5,135,575. In the process described there, magnesium stearate is processed with organic solvents such as, e.g., isopropanol, chloroform, acetone or heptane to a paste, mixed with polyorganosiloxane or mineral oil and ground in a mill. A disadvantage of this method of preparation is that magnesium stearate is incorporated in the fine-particle form in the silicone oil by means of an elaborate grinding process. Moreover, the use of organic solvents entails the expensive recovery of the solvents, and there is also a risk of ignition or explosion of the solvent, depending on the nature of the solvent.

A preparation for reducing the adhesion of polyurethane fibers is described in the patent JP188 875. This is composed of a polydimethylsiloxane, a higher alcohol, the ethers thereof or a fatty acid ester composed of a fatty acid with at least 12 carbon atoms, a modified silicone and the metal salt of a fatty acid with at least eight carbon atoms. The disadvantage of the preparation mentioned, however, is similar to that of the other well known preparation described above. During application to polyurethane fibers, the dispersed metal soaps lead to deposits in the preparation system which may extend to blockages of preparation feed lines. In connection with this, the operating time of the spinning machines is reduced. The expenditure for cleaning the spinning machines and the preparation system is increased considerably. A reliable and uniform preparation of the polyurethane fibers over a long period is not achieved with such preparations.

The production of fine particles of fatty-acid metal salts in polydimethylsiloxane for the preparation is described in the patent JP 60 67 442 for reducing the adhesion of elastanes. Magnesium stearate or calcium oleate in a pressure-resistant vessel is dissolved in hexane or benzene at 140 or 130° C. and precipitated by rapid cooling at 10° C./min. The introduction of this dispersion into low-viscosity polydimethylsiloxane followed by distillation of hexane or benzene eventually leads to the ready to use preparation. A disadvantage of this preparation is the production process of the preparation which is laborious and expensive due to the distillation of hexane or benzene. Moreover, due to the use of organic solvents there is a risk of contaminating the environment or of ignition or explosion of the solvent.

The patent DD 251 578 describes the use of an aqueous suspension with finely divided magnesium and/or calcium stearate and optionally polydimethylsiloxane as a preparation for reducing the adhesion of elastanes produced by the wet spinning process. A disadvantage of this invention, however, is that a special drying of the fiber is required to remove the water from the dispersion after application to the polyurethane fiber. This entails an additional processing stage which makes the product more expensive.

The object of the invention is to provide a preparation for fibers, particularly for elastanes, which can be processed without difficulty during application by, for example, roll, yarn guide or spray methods, and which does not lead to deposits in the preparation system or on processing machines during the application and particularly the processing of elastanes with, for example, cotton or polyamide fibers to flat goods. The stickiness of elastanes should be reduced by the preparation and the processability of elastanes coated with the preparation should be guaranteed even after a long storage period. A further requirement to be met by preparations for elastanes which, if they contain solids, are in the form of dispersions, is to ensure a uniform application of the preparation and, combined with this, a uniform application of solids by stabilising the preparation against sedimentation. For this reason, a particular requirement to be met by a suitable solids-containing preparation is that not more than 20% of the solids in the preparation should settle out after a lengthy storage period of e.g. 10 days, and that it must also be possible to convert the preparation oil from this state back to a homogenous dispersion by simple measures.

The stability of dispersions depends on many factors such as, e.g., the particle size and shape, polarity, charge and density. Of all these factors, however, the particle size is the most important parameter affecting sedimentation stability. A primordial aim during the production of suitable dispersions must be, therefore, to obtain the lowest possible particle size of the solid in the preparation, and the primary particles must not agglomerate to clusters.

In practice, laborious wet or dry grinding operations are carried out in order to produce the well known preparations. Another object of the invention is to provide an improved process for the production of preparations for fibers which renders grinding superfluous.

The invention is based on the discovery that preparation oils for fibers, particularly for polyurethane fibers, that are to comply with the above-mentioned requirements may be produced by means of a certain choice of composition of the preparation combined with a special precipitation process.

The invention relates to a coating compound for fibers, particularly for elastane fibers, based on a dispersion of fatty-acid metal salt and agglomeration inhibitor in a mixture of polyorganosiloxane and mineral oil containing at least A) from 30 to 98.97 wt. %, preferably from 50 to 96.9 wt. %, particularly preferably from 70 to 94.8 wt. % of polyalkylsiloxane with a viscosity of 2 to 150 mPas (25° C.), B) from 0.01 to 20 wt. %, preferably from 0.05 to 8 wt. %, particularly from 0.1 to 4 wt. %, more particularly preferably from 0.1 to 2 wt. % of metal salt of a saturated or unsaturated, mono- or bifunctional $C_6$–$C_{30}$ fatty acid, the metal being one of the first, second or third main group of the periodic system or Zn, C) from 1 to 69 wt. %, preferably from 3 to 50 wt. %, particularly preferably from 5 to 30 wt. % of a mineral oil with a viscosity of 2 to 500 mPas (25° C.), a density of 800 to 900 kg/m$^3$ (15° C.) and a viscosity-density constant (VDC) of 0.770 to 0.825, D) from 0.02 to 15 wt. %, preferably from 0.05 to 5 wt. %, particularly preferably from 0.1 to 3 wt. % of agglomeration inhibitor selected from the series comprising cationic, anionic or nonionic, particularly anionic or nonionic antistatic compounds.

Due to the incompatibility of the metals salts of fatty acids with polyorganosiloxanes, the preparation oils according to the invention for fibers, particularly polyurethane fibers, are in the form of dispersions.

Mineral oil is understood in this context to be a liquid distillation product (e.g. from petroleum), which is composed substantially of a mixture of saturated hydrocarbons.

The coating compounds according to the invention contain linear and/or branched polyorganosiloxanes, preferably linear polyorganosiloxanes and particularly preferably linear polydimethylsiloxanes with a viscosity of 2 to 150 mPas (25° C.), preferably with a viscosity of 2.5 to 50 mPas (25° C.) and particularly preferably with a viscosity of 2.5 to 20 mPas (25° C.). The linear or branched polyorganosiloxane content, preferably linear polyorganosiloxane and particularly preferably linear polydimethylsiloxane, is from 30 to 98.97 wt. %, preferably 50 to 96.9 wt. % and particularly preferably 70 to 94.8 wt. %, based on the weight of the preparation according to the invention.

The metal salts of fatty acids used in the production of the preparations according to the invention are those of which the metal is a metal of the first to third main group of the periodic system or zinc. The fatty acids are saturated or unsaturated, composed of at least six and at most 30 carbon atoms and are mono- or bifunctional. The metal salts of fatty acids are particularly lithium, magnesium, calcium, aluminium and zinc salts of oleic, palmitic or stearic acid, particularly preferably magnesium stearate, calcium stearate or aluminium stearate. The metal salt content of fatty acids in the preparation according to the invention is from 0.01 to 20 wt. %, preferably from 0.05 to 8 wt. %, particularly preferably from 0.1 to 4 wt. %, more particularly preferably from 0.1 to 2 wt. %, based on the weight of the preparation.

The mineral oils of the coating compound according to the invention have a viscosity of 2 to 500 mPas (25° C.), preferably 3 to 300 mPas (25° C.) and particularly preferably 3 to 200 mPas (25° C). The mineral oils are, moreover, characterised by a density of 800 to 900 kg/m$^3$ (15° C.) and a viscosity-density constant (VDC, determination according to DIN 51378) of 0.770 to 0.825. The mineral oil content in the preparation according to the invention is from 1 to 69 wt. %, preferably from 3 to 50 wt. % and particularly preferably from 5 to 30 wt. %, based on the weight of the preparation.

Agglomeration inhibitors contained in the preparations according to the invention are cationic, anionic or nonionic antistatic compounds, optionally also in mixture. A review of possible antistatic compounds is given in the book "Kunststoff additive" by R. Gachter and H. Müller, Carl-Hanser-Verlag, Munich, vol. 3, 1990, pages 779 to 805. Examples of cationic agglomeration inhibitors are ammonium compounds, examples of anionic agglomeration inhibitors are salts of sulfonic or phosphoric acids, and examples of nonionic agglomeration inhibitors are fatty or phosphoric acid esters, alkoxylated fatty alcohols, polyaminosiloxanes or alkoxylated polyorganosiloxanes. Suitable anionic agglomeration inhibitors are: fatty alcohols such as sodium lauryl sulfate or ammonium lauryl sulfate, fatty alcohol ether sulfates having the formula $R\text{-}(O\text{-}CH_2\text{-}CH_2)_n\text{-}OSO_3Na$, where R stands for hydrogen or an alkyl group with 1 to 30 hydrocarbon atoms and n stands for a number from 1 to 20, sodium alkylsulfoacetate having the formula $R\text{-}O\text{-}CO\text{-}CH_2\text{-}SO_3Na$, where R stands for an alkyl group with 1 to 30 hydrocarbon atoms, alkylolamide sulfates having the formula $R\text{-}CONH\text{-}(CH_2)_n\text{-}OSO_3Na$, where R stands for an alkyl group with 1 to 30 hydrocarbon atoms and n stands for a number from 1 to 6, or fatty alcohol ether phosphates having the formula $R\text{-}O\text{-}(CH_2\text{-}CH_2\text{-}O)_n\text{-}PO(ONa)_2$, where R stands for hydrogen or an alkyl group with 1 to 30 hydrocarbon atoms and n stands for a number from 1 to 20.

Suitable cationic agglomeration inhibitors are:

quaternary ammonium salts having the formula $R_1R_2R_3R_4N^+Cl^-$ where $R_1$, $R_2$, $R_3$ and $R_4$, independently of one another, are the same or different and stand for hydrogen or an alkyl group with 1 to 30 carbon atoms.

Suitable nonionic agglomeration inhibitors are:

Polyoxyethylene fatty alcohol ethers, polyoxyethylene fatty acid esters, polyoxyethylene glycol fatty acid esters, diethylene glycol monofatty acid esters, fatty acid alkanolamides having the formula R—CO—NH—$(CH_2—CH_2)_n$—OH, where R stands for an alkyl group with 1 to 30 hydrocarbon atoms and n stands for a number from 1 to 20, sucrose esters, e.g. sucrose palmitate, pentaerythritol partial esters, e.g. pentaerythritol monostearate, ethoxylated pentaerythritol partial esters, e.g. pentaerythritol monostearate polyglycol ether, sorbitan fatty acid esters or ethoxylated sorbitan fatty acid esters. In preference, anionic and/or nonionic agglomeration inhibitors are added to the preparation according to the invention, agglomeration inhibitors from the groups comprising sulfonic acids and the fatty and phosphoric acid esters being particularly preferred. Agglomeration inhibitors from the groups comprising dialkylsulfosuccinates, nonionic phosphoric acid esters and sugars esterified with fatty acids are more particularly preferred.

The dialkylsulfosuccinates correspond to the general formula (I)

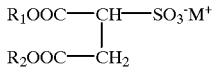

(I)

where $R_1$ and $R_2$ independently of one another, are the same or different and stand for hydrogen or an alkyl group with 1 to 30 carbon atoms, and preferably stand for an alkyl group with 4 to 18 carbon atoms, and $M^+$ is $H^+$, $Li^+$, $Na^+$, $K^+$ or $NH_4^+$.

The dialkylsulfosuccinates may be prepared, for example, as described in the journal C. R. Carly, Ind. Eng. Chem., Vol. 31, page 45, 1939.

Preferred examples of the dialkylsulfosuccinates are sodium bis-tridecyl sulfosuccinate, sodium dioctylsulfosuccinate, sodium dihexylsulfosuccinate, sodium diamylsulfosuccinate, sodium diisobutylsulfosuccinate, and sodium dicyclohexylsulfosuccinate.

Particularly preferred dialkylsulfosuccinates are sodium bis-tridecylsulfosuccinate, sodium dioctylsulfosuccinate and sodium dihexylsulfosuccinate.

Phosphoric acid esters as suitable nonionic agglomeration inhibitors correspond preferably to the general formula (2)

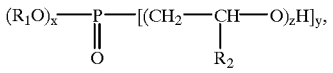

(2)

where $R_1$ and $R_2$, independently of one another, stand for hydrogen or an alkyl group with 1 to 30 carbon atoms and preferably stand for an alkyl group with 4 to 22 carbon atoms, x and y, independently of one another, are a number from 0 to 3, and in their sum are 3, and z is a number from 1 to 25.

Particularly preferred examples of phosphoric acid esters are those in which $R_1$ stands for an alkyl group with 14 to 20 carbon atoms, $R_2$ stands for hydrogen or a methyl group and x and y correspond to a number of 1 or 2 and z to a number from 3 to 10.

The agglomeration inhibitor D) content in the preparation according to the invention is from 0.02 to 15 wt. %, preferably 0.05 to 5 wt. % and particularly preferably 0.1 to 3 wt. %, based on the weight of the preparation.

The invention also relates to a process for the production of a coating compound for fibers based on a dispersion of fatty-acid metal salts and an agglomeration inhibitor in a mixture of polyorganosiloxane and mineral oil, which is characterised in that from 0.01 to 20 wt. %, preferably from 0.05 to 8 wt. %, particularly preferably from 0.1 to 4 wt. %, more particularly preferably from 0.1 to 2 wt. % of metal salt B) of a saturated or unsaturated. mono- or bifunctional $C_6$–$C_{30}$ fatty acid is dissolved in from 1 to 69 wt. %, preferably from 3 to 50 wt. %, particularly preferably from 5 to 30 wt. % of a mineral oil C), with heating to 70 to 170° C., preferably 100 to 140° C., the hot solution is mixed intensively and rapidly in a mixing device with from 30 to 98.97 wt. %, preferably from 50 to 96.9 wt. %, particularly preferably from 70 to 94.8 wt. % of polyalkylsiloxane A), the resulting dispersion is optionally homogenised directly afterwards, and from 0.02 to 15 wt. %, preferably from 0.05 to 5 wt. %, particularly preferably from 0.1 to 3 wt. % of agglomeration inhibitor D) is added to the mineral oil C) or to the polyalkylsiloxane A) prior to mixing or to the resulting dispersion before or preferably after homogenisation.

Homogenisation is carried out preferably by introducing shear energy with an energy density, based on the volume of the preparation, of at least $10^6$ J/m$^3$, particularly preferably at least $3\times10^6$ J/m$^3$, more particularly preferably at least $4\times10^6$ J/m$^3$.

The fine-particle nature and the sedimentation stability are hereby promoted.

The production of the preparations according to the invention, which are in the form of dispersions, is carried out by a precipitation process by dissolving fatty-acid metal salts in hydrocarbons under hot conditions and combining this phase with the polyorganosiloxane-containing phase. Precipitation may be carried out in a precipitation device composed of a two-stage or multi-stage dispersion device optionally followed by a homogenising stage. The production of the preparations according to the invention may also be carried out by introducing the phase containing metal salt into the phase containing polyorganosiloxane in a reactor followed by homogenisation by means of a homogenising device. In all cases, the agglomeration inhibitor may be added at any place during the production of the preparation.

A suitable multi-stage dispersion device and a homogenising nozzle is described in U.S. Pat. No. 5,302,660. The apparatus described is used to achieve rapid thorough mixing of two mass streams which are to be caused to undergo a chemical reaction with one another. The execution of a precipitation process in the apparatus mentioned optionally followed by homogenisation, which leads to fine-particle and sedimentation-stable dispersions with a narrow particle size distribution which are free from agglomerates is not, however, described and is otherwise unknown.

The preparation of dispersions by crystallisation of emulsions is described in the patent application EP-399 266. The basis of the process is that a melt is mixed with a colder liquid phase at a temperature below the crystallisation point and emulsified therein, whereby the melt solidifies only after emulsification, in the form of dispersed particles. To this end, the melt is injected into the liquid phase to form a pre-emulsion, and the pre-emulsion is finely dispersed in a downstream homogenising nozzle to an emulsion which then solidifies to the finished crystal suspension. The execution of a precipitation process in which, immediately after combining a phase composed of a solid and a solvent with another phase, substantially a non-solvent, in nozzle mixers optionally followed by homogenisation during which fine-grained and sedimentation-stable dispersions with a narrow particle size distribution are formed which are free from agglomerates is not, however, described in EP-399 266 and also otherwise unknown.

The known dispersion devices allow two mass streams to be mixed together very rapidly. It was found that, due to the introduction of high shear energy when using such devices for the production of preparation oils for fibers according to the precipitation process of the invention, the fatty-acid metal salts can be incorporated in polyorganosiloxanes with the formation of a good and narrow particle size distribution, free from agglomerates and stable towards sedimentation.

The process for the production of the preparations according to the invention using a two-stage or multi-stage dispersion device optionally followed by homogenisation is preferred to a precipitation process in a reactor followed by homogenisation because this process can be operated continuously.

The invention also relates to fibers, particularly polyurethane fibers, which are coated with the coating compound according to the invention.

The polyurethane fibers coated with the coating compound according to the invention are composed particularly of segmented polyurethane polymers, for example, those based on polyethers, polyesters, polyether esters and/or polycarbonates. Such fibers may be produced according to processes known in principle, such as, for example, those described in the patents U.S. Pat. Nos. 2,929,804, 3,097,192, 3,428,711, 3,553,290 and 3,555,115 and in the patent WO-9 309 174. Moreover, the polyurethane fibers may be composed of thermoplastic polyurethanes, the production of which is described, for example, in the patent U.S. Pat. No. 5,565,270. The polyurethane is based in particular on organic diisocyanates and a chain extender with several active hydrogens such as e.g. diols and polyols, di-and polyamines, hydroxylamines, hydrazines, semicarbazides, water or a mixture of these components. Preferred diols are glycol, butane diol and hexane diol. Preferred diamines are ethylene diamine, 1,2-propane diamine, 2-methyl-1,5-diaminopentane, 1,3-diaminocyclohexane, and 1-methyl-2,4-diaminocyclohexane.

The fibers may contain a plurality of various other additives for various purposes, such as, for example, antioxidants, heat, light and UV radiation stabilisers, pigments and flatting agents, dyes and lubricants. Examples of antioxidants, heat, light and UV stabilisers are stabilisers from the group comprising sterically hindered phenols, HALS stabilisers (hindered amine light stabiliser), triazines, benzophenones and benzotriazoles. Examples of pigments and flatting agents are titanium dioxide, zinc oxide and barium sulfate. Examples of dyes are acid dispersion and pigment dyes and optical brighteners. Examples of lubricants are metal salts of fatty acids and silicone and mineral oils. The additives mentioned are metered in such a way that they do not exhibit any effects adverse to the preparation oil applied externally to the fiber and produced by a precipitation process.

The coating compounds for fibers according to the invention which are in the form of dispersions and, in comparison with a conventional grinding process, may be produced by a simple and economic precipitation process in a mixing nozzle or in a reactor followed by homogenisation, have, as is shown in Example 1, the surprising advantage that they are very fine-particle with an average particle size of D50<3 μm and have a very narrow particle size distribution, and have a very small proportion of coarse-grained particles, with a D90 of <10 μm. The coating compounds are free from agglomerates and are stabilised satisfactorily against sedimentation with a sedimentation rate of <20% per 10 days.

Even with a composition of the coating compound according to the invention which has only 2 wt. % and below of fatty-acid metal salt, the outstanding properties of the coating compound are maintained.

In the case of well known preparation agents containing fatty-acid metal salt, the sedimentation rate of the salt is significantly higher. Metal salt is deposited e.g. at the preparation site. A uniform application of the metal salt onto the fibers is prevented. A further disadvantage of the known preparation agent is that, during further processing of the fibers coated therewith to flat goods, fatty-acid metal salt is deposited on machine parts e.g. knitting needles, and causes blockages of the needle eyes or thread breakage.

Moreover, if the fatty-acid metal salt content is less than 4 wt. %, a failure of the coating on the fiber is observed with well known preparations. As a result, the fibers stick together.

Moreover, if the coating compounds according to the invention are applied to polyurethane fibers, as is shown in Example 2, a surprising reduction in the electrical resistance of the fiber is found as a result even of small quantities of agglomeration inhibitor in the preparation. An electrostatic finish of the fiber is hereby achieved, which reduces or prevents, for example, electrostatic discharges during further processing of the fiber.

Moreover, if the coating compounds according to the invention are applied to polyurethane fibers, as is shown in Example 3, it is found, surprisingly, that as a result even of the small amount of a fatty-acid salt in the coating compound, the increased adhesion over a lengthy storage period of the fibers is greatly reduced even at elevated temperature, as is the stickiness of the polyurethane fibers associated with this, and the processing of the fibers on a circular knitting machine takes place satisfactorily without any deposits on the knitting needles.

Particularly surprisingly, as is also shown in Example 3, it was found that the coating compounds according to the invention did not exhibit any deposits or blockages in pipe lines of the coating compound or in preparation tanks during the application to polyurethane fibers by means of a preparation roll, even in long-term tests. The application of the coating compound over a long period of time is thereby made possible. Moreover, the uniformity of application is improved, and an interruption of a production process on account of the cleaning operations required is superfluous.

The test methods described below are used to measure the parameters discussed above in the examples.

The measurements for determining the particle size distributions are carried out with Mastersizer M20, Malvern Instruments, by means of laser light diffraction and laser light scattering. The dispersing agent used is polydimethylsiloxane with a viscosity of 10 mPas (25° C.). The particle size of the particles is given in micrometers (μm) as a function of the volumetric distribution of the particles at 10, 50 and 90% before and after an ultrasonic treatment for 180 s. The difference between the particle size distributions before and after the ultrasonic treatment is a measure of the presence of agglomerates. If the difference is small, no agglomerates are present.

In order to determine the sedimentation behaviour, 100 ml of preparation oil in the form of a dispersion are introduced into a measuring cylinder and the proportion of demixed phase in percent is determined after three and ten days. Stabilisation against sedimentation is achieved if the clear phase is <20% even after ten days.

The viscosity of the preparation oils is determined with a viscometer made by Haake, model CV 100 at a temperature of 20° C. and a shear speed of 300 $s^{-1}$.

The electrical conductivity of polyurethane fibers brightened with various preparations is determined by the measurement described in DIN 54 345 for determining the volume resistance.

The adhesion of the thread to a bobbin is determined by first trimming off the thread of a bobbin with a weight of 500 g to 3 mm above the bobbin case. A weight is then suspended on the thread and the weight with which the thread rolls off the bobbin is determined. The adhesion thus determined is a measure of the processability of the bobbins. If the adhesion is too great, the processability to flat goods is made more difficult because of thread breakage. The determination of adhesion after a storage period of 8 weeks at an elevated temperature of 40° C. describes an ageing process and is a measure of the development of adhesion after a lengthy storage period at room temperature. The storage of the bobbins takes place at 40° C. in a hot cabinet with a relative humidity of 60%. After storage, the adhesion is measured in the manner already described above.

The processability of polyurethane fibers was tested on a circular knitting machine made by Terrot. Flat goods with 20 wt. % polyurethane fibers and 80 wt. % cotton were produced. The test was carried out on a full circular knitting unit over a period of 5 h.

The determination of deposits in the preparation system is carried out by applying the preparation oil by a rolling method to a polyurethane fiber in a long-term test over 14 days without interruption. At the end of the test, an assessment is made as to how much solid has been deposited from the dispersion in the preparation system. The more deposits are present, the less suitable the preparation, since the preparation system with storage vessel, pipelines and preparation tanks and rolls and thread guides or spray nozzles has to be cleaned more frequently and a production process therefore has to be interrupted more frequently.

The precipitation process for the production of the coating compounds according to the invention is explained below by way of example on the basis of drawings.

BRIEF DESCRIPTION OF DRAWINGS

FIG. 1 shows, by way of example, the flow diagram of the process for the precipitation of fatty-acid metal salt in polyorganosiloxane. The two mass streams e.g. fatty-acid metal salts dissolved in mineral oil and polyorganosiloxanes are metered from batch containers 6 and 7 by means of metering pumps 8 and 9 into the short-term mixing device 1 and a downstream homogenising vessel 2, and the finished preparation oil is drained off into the product container 12. The agglomeration inhibitor may be added in a suitable form to the batch containers 6 or 7, or to the product container 12. The admission pressure before the mixing vessel is controlled by means of pressure meters 10 and 11.

FIG. 2 shows the flow diagram of a variant of the process according to the invention. The phase of fatty-acid metal salt and mineral oil from batch container 6 is introduced into the polyorganosiloxane in mixing vessel 7 and mixed. The mixture is conveyed by means of metering pump 9 through the homogeniser 15 and the finished preparation oil is drained off into the product container 12.

Figure 1:
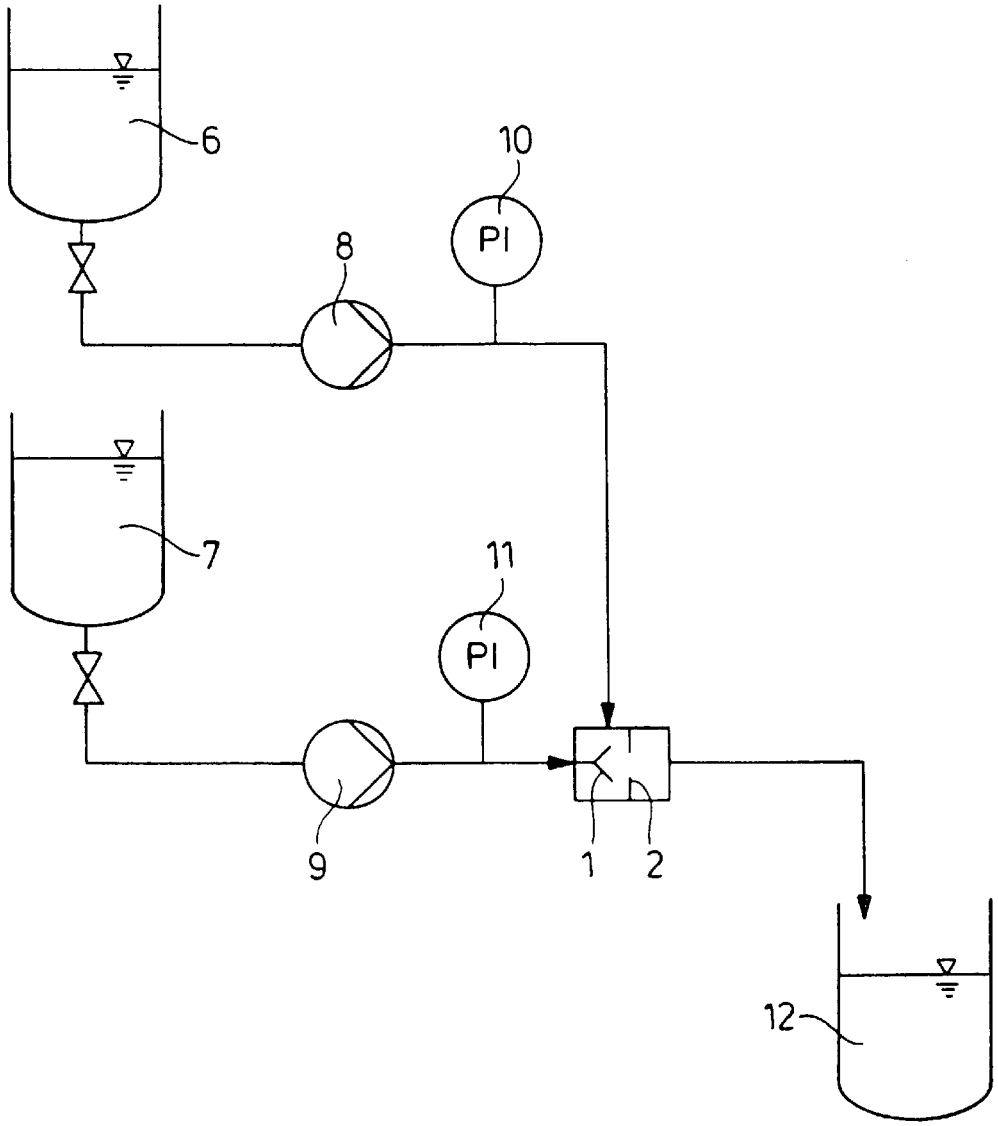
FIG. 1 shows a diagram of the overall process for the production of the coating compound according to the invention by means of a two-stage dispersion device optionally followed by homogenising.

The agglomeration inhibitor D may be added in a suitable form to the batch containers 6 or 7 or to product container 12.

The invention is explained in more detail in the examples below. The examples do not, however, represent a limitation of the preparations according to the invention or of the production processes thereof.

EXAMPLES

The examples below confirm the advantageous composition and the improved production processes of the coating compounds for fibers according to the invention by means of a precipitation process.

The polyurethane fibers for testing the processing properties of fibers with the new preparations were produced by reacting polytetrahydrofuran (PTHF) with an average molecular weight of 2000 g/mol with methylene-bis(4-phenyldiisocyanate) (MDI) in a molar ratio of 1 to 1.8. The prepolymer thus prepared was diluted with dimethylacetamide and then chain-extended with a mixture of ethylene diamine (EDA) and diethylamine (DEA) (ratio 97:3) in dimethylacetamide. The molar ratio of chain extender and chain terminator to unreacted isocyanate in the prepolymer was 1.075. The solids content of the segmented polyurethane thus produced was 30 wt. %. The polyurethane-urea solution has a viscosity of 120 Pas (50° C.) and the polymer has an intrinsic viscosity of 0.98 g/dl (measured at 25° C. in dimethylacetamide with a concentration of 0.5 g of polymer in 100 ml of dimethylacetamide). Before the dry spinning process, the following additives were added to the polyurethane-urea spinning solution (percentages based on the weight of the finished fiber): (a) 1.0% 1,3,5-tris(4-tert.-butyl-3-hydroxy-2,5-dimethylbenzyl)-1,3,5-triazine-2,4,6-(1H,3H,5H)tione (Cyanox 1790, Cytec), (b) 0.05% titanium dioxide (type RKB 2, Bayer AG), (c) 0.15% magnesium stearate, (d) 0.001% Makrolex violet (Bayer AG) and 0.15% polyalkyloxy-modified polydimethylsiloxane (Silwet L 7607, OSI Specialites). The finished spinning solution was spun to filaments with a titre of 11 dtex by spinnerets in a typical spinning apparatus for a dry spinning process, in each case four individual filaments being combined to coalescing filament yarns. The preparations in the form of dispersions were applied to the fiber by means of a preparation roll in a quantity of 4 wt. % based on the weight of the fiber. The fiber was then wound up at a rate of 900 m/min.

Example 1

In this Example, the particle size distribution, the viscosity and the sedimentation behaviour were compared as properties of preparations as a function of the composition and the process for the production of the preparations. The results are summarised in Table 1.

TABLE 1

Comparison of preparations as a function of the production process

| Experiment | Process for production of preparation | Composition of preparation/wt. % | Particle size distribution/μm (0 to 180 sec ultrasonic treatment) D10 | D50 | D90 | Viscosity mPas (25° C.) | Sedimentation/% clear phase 3d | 10d |
|---|---|---|---|---|---|---|---|---|
| 1-1 | Grinding (1 grinding operation) | 92% silicone oil b)<br>4% polyamylsiloxane c)<br>4% Mg stearate | 2.2/2.2 | 8.0/8.0 | 21.5/21.1 | 15.4 | 52 | 70 |
| 1-2 | Grinding (5 grinding operations) | 92% silicone oil b)<br>4% polyamylsiloxane c)<br>4% Mg stearate | 0.5/0.6 | 3.4/3.6 | 11.8/11.7 | 18.5 | 12 | 30 |
| 1-3 | Grinding (5 grinding operations) | 95% silicone oil b)<br>4% polyamylsiloxane c)<br>1% Mg stearate | 0.4/0.5 | 3.3/3.4 | 11.5/11.4 | 15.1 | 45 | 63 |
| 1-4 | Precipitation in mixing nozzle | 96% silicone oil d)<br>4% Mg stearate<br>60% hexane e) | 0.7/0.6 | 2.0/1.9 | 4.4/4.8 | 4.5 | 4 | 10 |
| 1-5 | Precipitation in mixing nozzle | 89% silicone oil d)<br>10% mineral oil f)<br>1% Mg stearate | 0.5/0.3 | 1.8/0.8 | 4.8/2.8 | 4.9 | 0 | 0 |
| 1-6 | Precipitation in mixing nozzle | 85% silicone oil d)<br>36% silicone oil b)<br>4% polyamylsiloxane c)<br>10% mineral oil f)<br>1% Mg stearate | 0.5/0.6 | 1.9/2.1 | 4.5/4.9 | 6.9 | 6 | 18 |
| 1-7 | Precipitation in mixing nozzle | 88% silicone oil d)<br>10% mineral oil f)<br>1% phosphate g)<br>1% Mg stearate | 0.9/0.5 | 3.1/2.2 | 9.1/8.6 | 13.6 | 4 | 12 |
| 1-8 | Precipitation in mixing nozzle | 75.5% silicone oil b)<br>20% mineral oil f)<br>1% phosphate g)<br>0.5% Na dioctylsulfo-succinate<br>3% Mg stearate | 1.4/1.0 | 3.3/2.7 | 7.0/6.0 | 23.1 | 0 | 0 |
| 1-9 | Precipitation in reactor followed by homogenising | 88% silicone oil d)<br>10% mineral oil f)<br>1% fatty alcohol EO adduct h)<br>1% Mg stearate | 1.5/0.5 (j)<br>0.3/0.3 (k) | 7.4/2.6 (j)<br>1.1/0.9 (k) | 28.4/9.4 (j)<br>4.4/3.4 (k) | 7.0 (j)<br>8.4 (k) | 3 (j)<br>1 (k) | 6 (j)<br>3 (k) |
| 1-10 | Precipitation reactor followed by homogenising | 88% silicone oil d)<br>10% mineral oil f)<br>1% phosphate g)<br>1% Mg stearate | 3.6/0.4 (j)<br>0.6/0.4 (k) | 15.9/1.7 )j)<br>3.5/1.2 (k) | 38.9/4.3 (j)<br>7.9/2.8 (k) | 5.8 (j)<br>7.5 (k) | 35 (j)<br>6 (k) | 50 (j)<br>18 (k) |
| 1-11 | Precipitation in reactor | 92% silicone oil b)<br>4% polyamylsiloxane c)<br>4% Mg stearate<br>100% hexane e) | 2.0/0.8 | 3.0/5.0 | 5.3/40.2 | 69.4 | 4 | 10 |

a) US = ultrasonic treatment in an ultrasonic bath;
b) polydimethylsiloxane (10 mPas/20° C.);
c) crosslinked polyamylsiloxane (15 Pas/20° C.);
d) polydimethylsiloxane (3 mPas/20° C.);
e) hexane is removed afterwards by distillation;
f) medical white oil (15 mPas/20° C.);
g) phosphoric acid distearylpentaethylene oxide ester;
h) $C_{12}/C_{14}$ pentaethylene oxide ether;
j) after precipitation in the reactor;
k) after homogenising.

In addition to low-viscosity silicone oil and polyamylsiloxane, the preparations 1-1 and 1-3 contain Mg stearate which was introduced by a grinding process with a pearl mill (MS 12 type, Fryma). The outcome of the particle size distribution is that although the particles are not in the form of agglomerates, the proportion of coarse-grained particles is large, with a D90 value of >10 μm, even after carrying out 5 grinding operations. Stabilisation against sedimentation improves as the particle size decreases (tests 1-1 and 1-2), but worsens as the Mg stearate content of the preparation falls, as shown in test 1-3. The reason for this may be too weak an interaction between the individual particles. In each case, however, the stabilisation of the preparations produced by a grinding process, with a sedimentation of >20%/10 d, is too great to be able to guarantee a uniform application of the preparation to fibers. Moreover, because of its poor effectiveness and hence poor economy, the grinding process is not suitable for the incorporation of finely divided Mg stearate in silicone oils.

The production of preparations 1-4 to 1-8 took place in a mixing nozzle 1 by means of the precipitation process described schematically in FIG. 1. A stream of hydrocarbon and Mg stearate at 130° C. (plus phosphate as agglomeration inhibitor in experiments 1-7 to 1-8) was combined with a stream of low-viscosity silicone oil (plus polyamylsiloxane in experiment 1-6) at 20° C. at a pressure of 50 bar in mixing nozzle 1 and then homogenised with an energy density of $5\times10^6$ J/m$^3$.

The ratios of the mass streams corresponded to those of the composition of the finished preparation. In experiment 1-4, hexane was removed in an additional step by distillation and in experiment 1-8, agglomeration inhibitor Na-dioctylsulfosuccinate was introduced into the preparation after precipitation. In all cases, the preparations obtained had a narrow particle size distribution and very finely divided particles with a D50 value of <3 μm, which contained no agglomerates and, with D90 values of <10 μm, contained a markedly lower proportion of coarse-grained particles in the preparations compared with the grinding process. The particle size distributions are therefore narrower, and the particle size thus more uniform. Moreover, all the preparation oils obtained, particularly those with small quantities of 1% Mg stearate, were stabilised against sedimentation, having a sedimentation rate of <20%/10 d.

Figure 2:
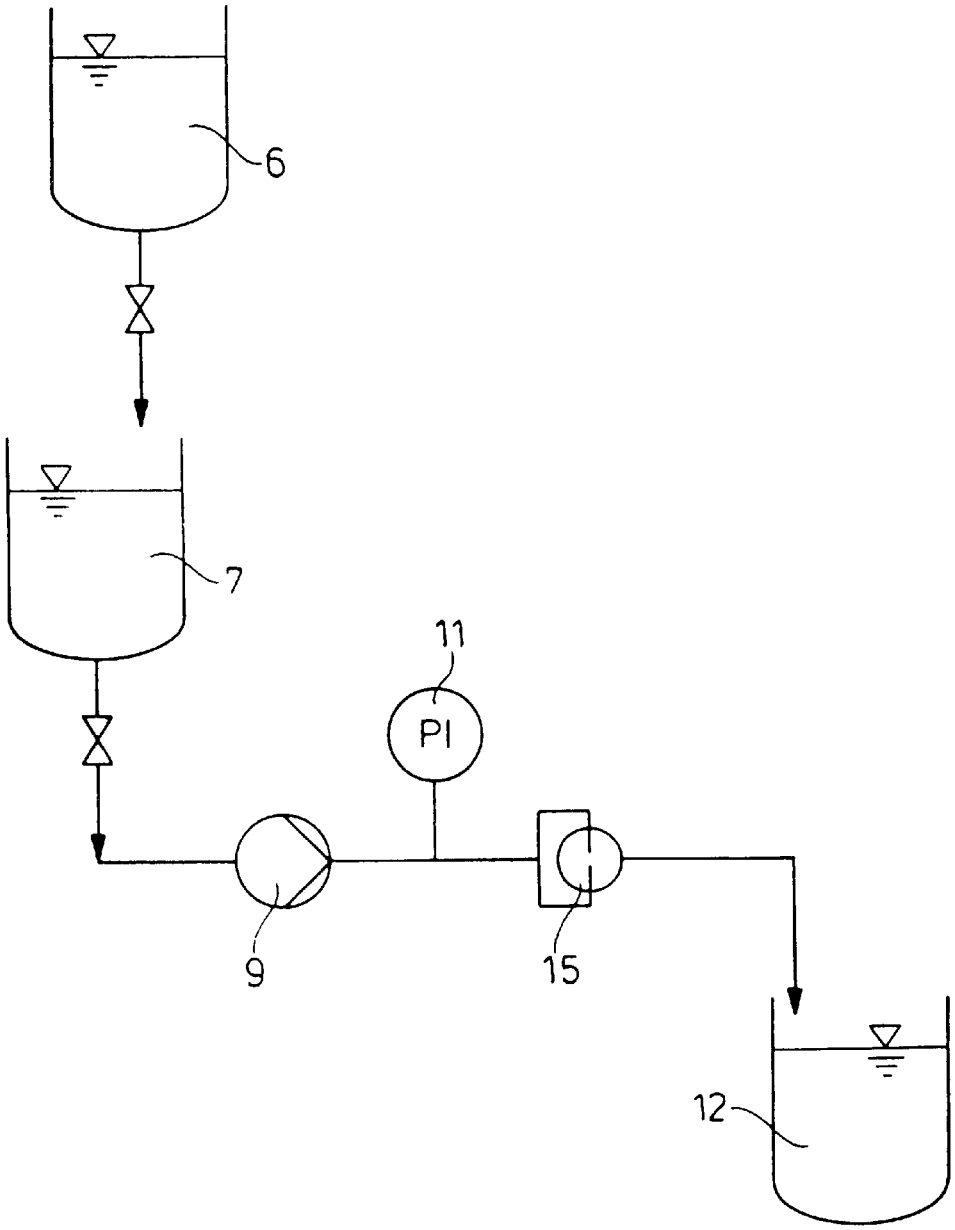
FIG. 2 shows a diagram of a further overall process for the production of the coating compound according to the invention with homogenising after prior precipitation in a reactor.

Preparations 1-9 and 1-10 were produced by the precipitation process described schematically in FIG. 2. in a reactor followed by homogenisation. A stream of mineral oil, Mg stearate and fatty alcohol EO adduct or phosphate at a temperature of 120° C. was introduced into a reactor, with stirring, with silicone oil at 20° C. and then homogenised by a homogeniser 15 (see FIG. 2) with an energy density of $5\times10^6$ J/m$^3$. Immediately after the precipitation process, the preparations contain agglomerates and exhibit an increased proportion of coarse particles, though with good stabilisation against sedimentation in experiment 1-9. As a result of homogenisation, the agglomerates in the preparation are broken and stabilisation against sedimentation improved. The preparations produced by precipitation in the reactor followed by homogenisation contain no agglomerates, as do those produced by precipitation in a mixing nozzle, with D90 values of <10 μm and a very small proportion of coarse particles, narrow particle size distributions and good stabilisation against sedimentation with sedimentation rates of <20%/10 d.

Experiment 1-11 shows the result of the characterisation of a preparation which was produced according to the patent JP 60-67 442 by a precipitation process of Mg stearate in hexane in a reactor followed by the addition of silicone oil and polyamylsiloxane and removal of hexane by distillation. The preparation exhibits good stabilisation against sedimentation, but because of the strong tendency to agglomerate and the high viscosity, presumably because of considerable interaction between solids particles in the preparation, is unsuitable as a preparation oil for the production of fibers, particularly polyurethane fibers.

Example 2

This Example shows that the electrical conductivity of polyurethane fibers can be altered as a function of the composition of the preparation. All the preparations, which were in the form of a dispersion, were produced by precipitation in a mixing nozzle 1 followed by homogenisation (corresponding to Examples 1–4). The results are given in Table 2.

TABLE 2

Electrical conductivity of polyurethane fibers with various preparations

| Experiment | Composition of preparation/wt. % (production of dispersions by precipitation in mixing nozzle 1) | Volume resistance/$10^{11}$ Ohm (measurement d.c voltage: 100 V) |
|---|---|---|
| 2–1 | 100% silicone oil a) | 2 |
| 2–2 b) | 90% silicone oil b)<br>10% polyamylsiloxane c) | 1.2 |
| 2–3 | 88.5% silicone oil a)<br>10% mineral oil d)<br>0.5% phosphate e)<br>1% Mg stearate | 1.4 |
| 2–4 | 88% silicone oil a)<br>10% mineral oil d)<br>1% phosphate e)<br>1% Mg stearate | 0.8 |
| 2–5 | 87.5% silicone oil a)<br>10% mineral oil d)<br>1% phosphate e)<br>0.5% Na-dioctylsulfosuccinate<br>1% Mg stearate | 0.07 |
| 2–6 | 88.5% silicone oil a)<br>10% mineral oil d)<br>0.5% Na dioctylsulfosuccinate<br>1% Mg stearate | 0.07 |

a) polydimethylsiloxane (3 mPas/20° C.);
b) polydimethylsiloxane (10 mPas/20° C.);
c) crosslinked polyamylsiloxane (15 Pas/20° C.);
d) medical white oil (15 mPas/20° C.);
e) phosphoric acid distearylpentaethylene oxide ester.

Experiment 2-2 confirms that polyamylsiloxane as a constituent of the preparation reduces the electrical volume resistance of polyurethane fibers, that is, this branched siloxane increases the electrical conductivity. This result corresponds to the observation made in the U.S. Pat. No. 3,296,063. Due to the incorporation of phosphate and/or Na-dioctylsulfosuccinate, however, the volume resistance of the polyurethane fiber was reduced even further, i.e. the electrical conductivity was increased further. Na-dioctylsulfosuccinate is the most effective means of reducing the volume resistance, ahead of the phosphate and this in turn ahead of polyamylsiloxane.

Example 3

This example shows which preparations reduce the stickiness of polyurethane fibers, and thus guarantee their processability even after a relatively long storage period at elevated temperature, as a function of the production process and the composition of preparations. Moreover, it shows which preparations, which are in the form of a dispersion, can be applied over a long period without the formation of deposits. The results are summarised in Table 3.

TABLE 3

Processing tests on polyurethane fibres with various preparations

| Experiment | Process for production of the preparations | Composition of the preparation (wt. %) | Adhesion/cN after production | after 8 weeks | Processability of stored bobbins on circular knitting machine not possible due to thread breakage | Assessment of deposits and blockages in the preparation system |
|---|---|---|---|---|---|---|
| 3-1 | | 100% silicone oil (3 mPas) a) | 0.1 | 1.4 | no possible due to thread breakage | — |
| 3-2 | | 90% silicone oil b)<br>10% polyamylsiloxane c) | 0.1 | 1.8 | not possible due to thread breakage | — |
| 3-3 | Grinding (5 grinding operations) | 92% silicone oil b)<br>4% polyamylsiloxane c)<br>4% Mg stearate | 0.1 | 0.5 | limited due to deposits on knitting needles | many |
| 3-4 | Precipitation in mixing nozzle | 49% silicone oil a)<br>36% silicone b)<br>4% polyamylsiloxane c)<br>10% mineral oil d)<br>1% Mg stearate | 0.1 | 0.5 | good | many |
| 3-5 | Precipitation in mixing nozzle | 88% silicone oil a)<br>10% mineral oil d)<br>1% phosphate c)<br>1% Mg stearate | 0.15 | 0.6 | good | many |
| 3-6 | Precipitation in reactor followed by homogenising | 88% silicone oil a)<br>10% mineral oil d)<br>1% phosphate c)<br>1% Mg stearate c) | 0.1 | 0.5 | good | many |
| 3-7 | Precipitation in reactor followed by homogenising | 88% silicone oil a)<br>10% mineral oil d)<br>1% fatty alcohol EO adduct f)<br>1% Mg stearate | 0.05 | 0.4 | good | many |
| 3-8 | Precipitation in mixing nozzle | 88.5% silicone oil a)<br>10% mineral oil d)<br>0.5% Na dioctylsulfosuccinate g)<br>1% Mg stearate | 0.15 | 0.35 | good | none |
| 3-9 | Precipitation in reactor followed by homogenising | 87.5% silicone oil) a)<br>10% mineral oil d)<br>1% phosphate e)<br>0.5% Na dioctylsulfosuccinate<br>1% Mg stearate | 0.15 | 0.25 | good | none |
| 3-10 | Precipitation in reactor followed by homogenising | 87.5% silicone oil a)<br>10% mineral oil d)<br>1% phosphate c)<br>0.5% Na bistridecylsulfosuccinate<br>1% Mg stearate | 0.15 | 0.25 | not tested | none |
| 3-11 | Precipitation in reactor followed by homogenising | 87% silicone oil a)<br>10% mineral oil d)<br>1% phosphate e)<br>1% sorbitan monolaurate<br>1% Mg stearate | 0.15 | 0.25 | not tested | none |
| 3-12 | Precipitation in reactor followed by homogenising | 87% silicone oil a)<br>10% mineral oil d)<br>1% phosphate e)<br>1% aminofunctionalised silicone oil g)<br>1% Mg stearate | 0.15 | 0.33 | not tested | none |

a) polydimethylsiloxane (3 mPas/20° C.);
b) polydimethylsiloxane (10 mPas/20° C.);
c) crosslinked polyamylsiloxane (15 Pas/20° C.);
d) medical white oil (15 mPas/20° C.);
e) phosphoric acid distearyl pentaethylene oxide ester;
f) $C_{12}/C_{14}$ pentaethylene oxide ether;
g) product Magnasoft Fluid from Witco.

Experiments 3-1 and 3-2 show that when preparations based on silicone oil or silicone oil with polyamylsiloxane are applied, the increase in adhesion of polyurethane fibers over a storage period of 8 weeks and at a temperature of 40° C., as often occurs during transport, in warehouses or subtropical countries, is very substantial and the bobbins cannot be processed. The values for adhesion obtained in these experiments lie above 1 cN, which is a limit for successful processability of polyurethane fibers on, for example, a circular knitting machine. So adhesion of more than 1 cN during the processing of bobbins can lead to thread breakages resulting in machine breakdown. In extreme cases, it may happen that thread can no longer be unwound from the bobbin. The preparations based on silicone oil or silicone oil with polyamylsiloxane used in experiments 3-1 and 3-2 are therefore unsuitable for the preparation of polyurethane fibers.

Experiments 3-3 to 3-12 show that the build up of adhesion of polyurethane fibers on bobbins is reduced if the preparation with Mg stearate contains a fatty-acid metal salt and is thus in the form of a dispersion. In all cases, adhesion values of <1 cN are found on the polyurethane bobbins even after storage for 8 weeks at a temperature of 40° C. As a result of this, the processing even of stored bobbins on a circular knitting machine is perfectly possible. The effectiveness of Mg stearate in the preparations for reducing the stickiness of polyurethane fibers is lower, however, in those that were produced by a grinding process than in those produced by precipitation in the mixing nozzle or precipitation in a reactor followed by homogenising. In the case of preparations produced by the precipitation processes described, 1 wt. % of Mg stearate is sufficient to reduce the stickiness of polyurethane fibers to the desired level. In the case of the preparation produced by a precipitation process, an Mg stearate content of 4 wt. % is required to obtain the same behaviour in terms of adhesion. A disadvantage associated with this of preparations produced by a grinding process is that considerable deposits form on the needles of the circular knitting machine when the polyurethane fibers are processed, to the extent that thread breakage can occur. In order to avoid thread breakage, a greater amount of time needs to be spent cleaning the circular knitting machine, which results in shorter running times of the machine. In the case of the preparations produced by the precipitation processes described, however, no deposits form on needles, the processability on the circular knitting machine being good due to the lower Mg stearate content. Long-term tests for assessing deposits and blockages in pipelines and preparation tanks due to the preparations in the form of dispersions of experiments 3-3 to 3-12 led to the result that, irrespective of the production process by grinding, precipitation in the mixing nozzle 1 or precipitation in the reactor followed by homogenising, many deposits and blockages occurred. These deposits and blockages are undesirable during the application of the preparation to polyurethane fiber because frequent cleaning cycles become necessary as a result. No deposits and blockages in pipelines and preparation tanks occurred, as shown in experiments 3-8 to 3-12, during the application of the preparations produced by precipitation in the mixing nozzle or precipitation in the reactor followed by homogenising, to which preparations agglomeration inhibitors such as, for example, salts of sulfonic acids, esterified sugars or functionalised silicone oils were incorporated.

What is claimed is:

1. A coating composition for fibers, in the form of a dispersion of a fatty-acid metal salt and an agglomeration inhibitor in a mixture of polyorganosiloxane and mineral oil, comprising A) from 30 to 98.97 wt. % of polyalkylsiloxane having a viscosity of 2 to 150 mPas (25° C.), B) from 0.01 to 20 wt. % of a metal salt of a saturated or unsaturated, mono- or bifunctional $C_6$–$C_{30}$ fatty acid, the metal being one of the first, second or third main group of the periodic system, or Zn, C) from 1 to 69 wt. % of a mineral oil having a viscosity of 2 to 500 mPas (25° C.), a density of 800 to 900 kg/$m^3$ (15° C.) and a viscosity-density constant (VDC) of 0.770 to 0.825, and D) from 0.02 to 15 wt. % of an agglomeration inhibitor selected from the group consisting of cationic anionic and nonionic antistatic compounds.

2. A coating composition according to claim 1, wherein the polyalkylsiloxanes A) are linear polyalkylsiloxanes having a viscosity of 2.5 to 50 mPas (25° C.).

3. A coating composition according to claim 1, wherein the fatty acid metal salt B) is selected from the group consisting of lithium, magnesium, calcium, aluminium and zinc salts of oleic, palmitic or stearic acid and mixtures thereof.

4. A coating composition according to claim 1, wherein the mineral oil C) has a viscosity of 3 to 300 mPas (25° C.).

5. A coating composition according to claim 1, wherein the cationic agglomeration inhibitor D) is an ammonium compound, the anionic agglomeration inhibitor D) is a salt of sulfonic or phosphoric acid or a dialkylsulfosuccinate, the nonionic agglomeration inhibitor D) is a fatty acid ester or phosphoric acid ester, alkoxylated fatty alcohol, aminofunctionalized or alkoxylated polyorganosiloxane.

6. A coating composition according to claim 5, wherein the agglomeration inhibitor D) is selected from the group consisting of dialkylsulfosuccinates, the phosphoric acid esters, polyaminofunctionalized polyorganosiloxanes and sugars esterified with fatty acids.

7. A coating composition according to claim 5, wherein the agglomeration inhibitor D) is a dialkylsulfosuccinate corresponding to the general formula (I)

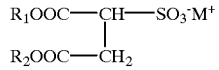

(I)

where $R_1$ and $R_2$ independently of one another, are the same or different and stand for hydrogen or an alkyl group with 1 to 30 carbon atoms, and $M^+$ is a cation selected from the group comprising $H^+$, $Li^+$, $NA^+$, $K^+$, or $NH_4^+$.

8. A coating composition according to claim 5, wherein the agglomeration inhibitor D) is a dialkylsulfosuccinate selected from the group consisting of sodium bis-tridecylsulfosuccinate, sodium dioctylsulfosuccinate, sodium dihexylsulfosuccinate, sodium diamylsulfosuccinate, sodium diisobutylsulfosuccinate, and sodium dicyclohexylsulfosuccinate.

9. A coating composition according to claim 5, wherein the agglomeration inhibitor D) is a phosphoric acid ester corresponding to the general formula (2)

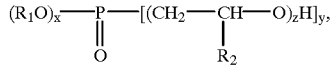

(2)

where $R_1$ and $R_2$ independently of one another, stand for hydrogen or an alkyl group with 1 to 30 carbon atoms, x and y, independently of one another, are a number from 0 to 3, and x+y=3, and z is a number from 1 to 25.

10. A coating composition according to claim 9, wherein the agglomeration inhibitor D) is a phosphoric acid ester corresponding to formula 2 in which $R_1$ stands for an alkyl group with 14 to 20 carbon atoms, $R_2$ stands for hydrogen or a methyl group and one of x and y is 1 and the other is 2 and z is a number of from 3 to 10.

11. A coating composition according to claim 1, in the form of a finely divided dispersion, having an average particle size of the dispersed solids particles of D50<3 $\mu$m, and a D90 value of <10 $\mu$m.

12. A coating composition according to claim 1, having a sedimentation rate of <20% in ten days.

13. A process for the production of a coating composition for fibers according to claim 1, wherein from 0.01 to 20 wt.

% of metal salt B) of a saturated or unsaturated, mono- or bifunctional $C_6$–$C_{30}$ fatty acid is dissolved in from 1 to 69 wt. % of a mineral oil C), with heating to 70 to 170° C., the hot solution is mixed intensively and rapidly in a mixing device with from 30 to 98.97 wt. % of polyalkylsiloxane A), the resulting dispersion is optionally homogenized directly afterwards, and wherein from 0.02 to 15 wt. % of agglomeration inhibitor D) is added to the mineral oil C) or to the polyalkylsiloxane A) prior to mixing or to the resulting dispersion before or after homogenization.

14. A process according to claim 13, wherein the agglomeration inhibitor D) is added to the dispersion of the coating compound directly after homogenization.

15. A process according to claim 13, wherein homogenization is carried out by introducing shear energy with an energy density, based on the volume of the preparation, of at least $10^6$ J/m$^3$.

16. Fibers coated with the coating composition of claim 1.

17. The fibers of claim 16, wherein said fibers are polyurethane fibers.

* * * * *